US008882241B2

(12) United States Patent
Sasaki

(10) Patent No.: US 8,882,241 B2
(45) Date of Patent: Nov. 11, 2014

(54) LIQUID-JET HEAD AND LIQUID-JET HEAD DEVICE

(75) Inventor: Takafumi Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/609,125

(22) Filed: Sep. 10, 2012

(65) Prior Publication Data

US 2013/0070018 A1 Mar. 21, 2013

(30) Foreign Application Priority Data

Sep. 15, 2011 (JP) ..... 2011-202341

(51) Int. Cl.

| | |
|---|---|
| ***B41J 2/19*** | (2006.01) |
| ***B41J 2/165*** | (2006.01) |
| ***B41J 2/175*** | (2006.01) |
| ***B41J 2/14*** | (2006.01) |

(52) U.S. Cl.

CPC ..... *B41J 2/14274* (2013.01); *B41J 2202/07* (2013.01); *B41J 2002/14403* (2013.01)

USPC ..... 347/34; 347/92; 347/93

(58) Field of Classification Search

USPC ..... 347/34, 92, 93

See application file for complete search history.

(56) References Cited

U.S. PATENT DOCUMENTS

| | | | | |
|---|---|---|---|---|
| 4,639,748 A * | 1/1987 | Drake et al. | ..... | 347/67 |
| 5,394,181 A * | 2/1995 | Braun | ..... | 347/92 |
| 5,650,812 A | 7/1997 | Ochi et al. | | |
| 6,685,299 B2 | 2/2004 | Hirota | | |
| 6,742,883 B1 | 6/2004 | Takata | | |
| 8,042,911 B2 | 10/2011 | Sasaki | | |
| 8,197,048 B2 | 6/2012 | Yamanaka et al. | | |

(Continued)

FOREIGN PATENT DOCUMENTS

| | | |
|---|---|---|
| EP | 1336487 A2 | 8/2003 |
| JP | 9-48116 | 2/1997 |

(Continued)

OTHER PUBLICATIONS

European official communication dated Dec. 6, 2012 in connection with corresponding European patent application No. 12181547.6.

*Primary Examiner* — Stephen Meier
*Assistant Examiner* — Alexander D Shenderov
(74) *Attorney, Agent, or Firm* — Cooper & Dunham LLP

(57) ABSTRACT

A liquid-jet head includes nozzles, pressurized chambers to communicate with the nozzles, a common liquid chamber to communicate with each of the pressurized chambers, each of the common liquid chamber and the pressurized liquid chambers having a negative pressure of a predetermined value, first communicating paths to communicate between the common liquid chamber and the pressurized liquid chamber to serve as a filter to prevent air bubbles from intruding into the pressurized liquid chamber, the filter having openings, each opening having an opening area smaller than an opening area of each of the nozzles, and an air bubble discharge chamber including a second communicating path to communicate with the common liquid chamber having an air bubble remaining part in a region downstream in a liquid flow direction, and an opening part from which the air bubbles having entered via the second communicating path are discharged during a maintenance-restoration operation.

9 Claims, 10 Drawing Sheets

(56) References Cited

U.S. PATENT DOCUMENTS

| | | | | |
|---|---|---|---|---|
| 2003/0156158 | A1 | 8/2003 | Hirota et al. | |
| 2003/0156159 | A1 | 8/2003 | Kobayashi | |
| 2003/0156162 | A1 | 8/2003 | Hirota et al. | |
| 2004/0233261 | A1* | 11/2004 | Clark et al. | 347/93 |
| 2007/0008388 | A1 | 1/2007 | Yamaguchi et al. | |
| 2009/0009569 | A1 | 1/2009 | Sasaki | |
| 2009/0201354 | A1* | 8/2009 | Akiyama et al. | 347/93 |
| 2010/0328409 | A1 | 12/2010 | Matsufuji et al. | |
| 2012/0069071 | A1 | 3/2012 | Sasaki | |

FOREIGN PATENT DOCUMENTS

| | | |
|---|---|---|
| JP | 11-221918 | 8/1999 |
| JP | 2005-262639 | 9/2005 |
| JP | 2006-218670 | 8/2006 |
| JP | 3885226 | 2/2007 |
| JP | 2009-66904 | 2/2009 |
| JP | 2011-25663 | 2/2011 |

* cited by examiner

LIQUID-JET HEAD AND LIQUID-JET HEAD DEVICE

BACKGROUND OF THE INVENTION

1. Field of the Invention

The embodiments discussed herein relate to a liquid-jet head and a liquid-jet device.

2. Description of the Related Art

A typical image forming apparatus includes an ink-jet recording device such as a printer, a facsimile machine, a copier, a plotter or a multifunctional peripheral having a combination of these functions. The ink-jet recording device includes a liquid-jet head configured to form an image on a medium such as a sheet by discharging ink drops on the sheet while transferring the sheet. The aforementioned "medium" or the "sheet" indicates any medium or sheet formed of any materials and hence is not limited to a medium or sheet of any particular material. Likewise, and a recording medium including a transitory recording medium and a non-transitory recording medium, a transfer material and a recording sheet may be used synonymously with the aforementioned medium or sheet that is formed of any materials. Further, the image forming apparatus may be any apparatuses that form an image by discharging a liquid on a medium such as paper, thread, fiber, cloth, hide, metal, plastic, glass, wood, ceramics and the like. The aforementioned "forming an image" not only indicates providing an image having meaning of a character or graphics on a medium but also indicates an image having no meaning such as a pattern on a medium by simply discharging a liquid. In addition, "ink" is not limited to those so-called "ink", but may be any liquid that is in a form of liquid when being discharged. The aforementioned "ink" is used as a generic name of liquids including DNA specimens, resist and a patterning material.

An ink-jet recording head in the ink-jet recording device (an example of the image forming apparatus) includes nozzles to discharge ink drops, a pressurized liquid chamber communicating with the nozzles, an actuator unit to generate energy to increase pressure in the pressurized liquid chamber and a common liquid chamber to supply ink from an ink tank such as an ink cartridge communicating with the pressurized liquid chamber. Hence, pressure in the pressurized liquid chamber is increased by driving the actuator unit to discharge the ink drops from the nozzles while an amount of ink equivalent to a discharged amount of ink drops is supplied from the common liquid chamber to the pressurized liquid chamber. In the ink-jet recording device, air bubbles or foreign particles may sometimes intrude into an ink flow path. When the air bubbles or foreign particles enter the pressurized liquid chamber, the nozzles may be clogged with the air bubbles or foreign particles to cause ink discharge malfunction. Japanese Patent No. 3885226 (Patent Document 1), for example, proposes a technique to prevent such ink discharge malfunction by providing a filter in the ink flow paths between the ink cartridges and the common liquid chamber. In the liquid-jet head disclosed in Patent Document 1, a filter is provided in each of communicating paths communicating between the common liquid chamber and the corresponding pressurized liquid chamber. The filter includes plural openings configured to block the air bubbles or foreign particles while maintaining the communication between the common liquid chamber and the corresponding pressurized liquid chamber.

RELATED ART DOCUMENT

Patent Document

Patent Document 1: Japanese Patent No. 3885226

However, in the liquid-jet head disclosed in Patent Document 1, the foreign particles or air bubbles generated in an ink supply tank or tube located upstream of the liquid-jet head may reach the common liquid chamber and remain or stay inside the common liquid chamber. This may cause the filter to be clogged with the foreign particles, which may gradually cause insufficient supply of a liquid (ink) to the pressurized liquid chamber. As a result, the pressure inside the pressurized liquid chamber may gradually become an excessively negative state every time the liquid-jet head ejects liquid drops. If the excessive negative pressure inside the pressurized liquid chamber exceeds tension held by the nozzles, the menisci of the nozzles are broken, which may cause air to intrude inside the nozzles. As a result, air flows back into the pressurized liquid chamber and then passes through the openings of the filter to reach the common liquid chamber, where a larger amount of air may reside. In a liquid-jet head having no such a filter, which differs from the liquid-jet head disclosed in Patent Document 1, foreign particles or air bubbles residing in the common liquid chamber may be discharged from the liquid-jet head together with ink remaining inside the liquid-jet head by placing caps on nozzle faces to cause the pressures inside the caps to be negative (i.e., negative pressure) during a maintenance-restoration operation. However, in the liquid-jet head having the filter similar to the one disclosed in Patent Document 1, foreign particles or air bubbles are hard to pass through the filter. Hence, even if the maintenance-restoration operation is conducted, the foreign particles or air bubbles inside the common liquid chamber may fail to be discharged from the liquid-jet head. This is because the filter serves its original function properly. However, at the same time, the foreign particles or air bubbles may be retained inside the liquid-jet head for a long period of time to clog the openings of the filters also serving as communicating paths arranged between the pressurized liquid chambers and the common liquid chamber. When the openings of the filter are clogged with the foreign particles or air bubbles, a sufficient amount of ink may not be supplied from the common liquid chamber to the corresponding pressurized liquid chamber, which may unfortunately result in ink discharge malfunction.

SUMMARY OF THE INVENTION

It is a general object of at least one embodiment of the present invention to provide a liquid-jet head and a liquid-jet device capable of suppressing liquid discharge malfunction caused by a filter between each of pressurized liquid chambers and a common liquid chamber, which substantially eliminate one or more problems caused by the limitations and disadvantages of the related art.

According to one embodiment, there is provided a liquid-jet head that includes a plurality of nozzles; a plurality of pressurized chambers configured to communicate with the respective nozzles; a common liquid chamber configured to communicate with each of the pressurized chambers, each of the common liquid chamber and the pressurized liquid chambers having a negative pressure of a predetermined value; a plurality of first communicating paths configured to communicate between the common liquid chamber and the corresponding pressurized liquid chamber, the first communicating paths serving as a filter to prevent air bubbles residing in the common liquid chamber from intruding into the corresponding pressurized liquid chamber, the filter having a plurality of openings, each of the openings having an opening area smaller than an opening area of each of the nozzles, the openings serving as a liquid flow path between the common liquid chamber and the corresponding pressurized liquid chamber; and an air bubble discharge chamber including a second communicating path configured to communicate with the common liquid chamber having an air bubble remaining part where air bubbles are likely to remain, the air bubble remaining part being located in a region downstream in a liquid flow direction inside the common liquid chamber, and an opening part from which the air bubbles having entered via the second communicating path are discharged, the entered air bubbles being discharged from the opening part during a maintenance-restoration operation.

According to another embodiment, there is provided a liquid-jet head that includes a plurality of nozzles; a plurality of pressurized chambers configured to communicate with the respective nozzles; a common liquid chamber configured to communicate with each of the pressurized chambers, each of the common liquid chamber and the pressurized liquid chambers having a negative pressure of a predetermined value; a plurality of first communicating paths configured to communicate between the common liquid chamber and the corresponding pressurized liquid chamber, the first communicating paths serving as a filter to prevent foreign particles residing in the common liquid chamber from intruding into the corresponding pressurized liquid chamber, the filter having a plurality of openings, each of the openings having an opening area smaller than an opening area of each of the nozzles, the openings serving as a liquid flow path between the common liquid chamber and the corresponding pressurized liquid chamber; and a foreign particle discharge chamber including a second communicating path configured to communicate with the common liquid chamber having a foreign particle remaining part where foreign particles are likely to remain, the foreign particle remaining part being located in a region downstream in a liquid flow direction inside the common liquid chamber, and an opening part from which the foreign particles having entered via the second communicating path are discharged, the entered foreign particles being discharged from the opening part during a maintenance-restoration operation.

According to another embodiment, there is provided a liquid-jet device that includes one of the aforementioned liquid-jet heads.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention, as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
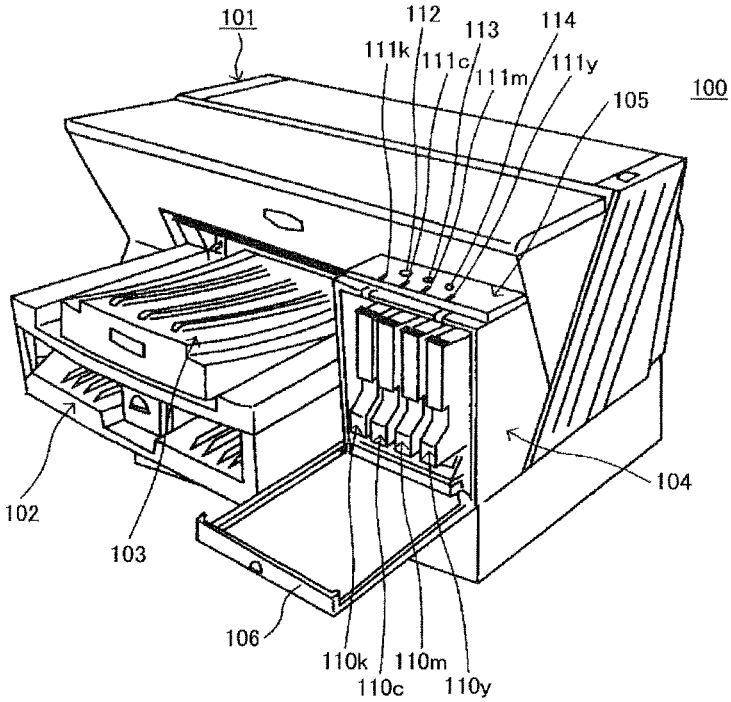
FIG. 1 is a perspective view illustrating an ink-jet recording device according to an embodiment as viewed from a front side.

A detailed description is given of an ink-jet recording device serving as an image forming apparatus to which preferred embodiments are applied with reference to the accompanying drawings. FIG. 1 is a perspective view illustrating an ink-jet recording device 100 according to an embodiment viewed from a front side. In FIG. 1, the ink-jet recording device 100 according to the embodiment includes a main body 101, a sheet-feeding tray 102 attached to the main body 101, and a catch tray 103 removably attached to the main body 101. The sheet-feeding tray 102 is utilized for supplying a sheet and the catch tray 103 is utilized for receiving the sheet after having formed (recorded) an image on the sheet. The ink-jet recording device 100 according to the embodiment further includes a cartridge attachment part 104 such that the cartridge attachment part 104 is projected from a front side (i.e., sheet-feeding tray and catch tray side) of the main body 101 and located at a position lower than an upper surface of the main body 101. There is provided an operation/display part 105 such as operations buttons and a display on the surface of the cartridge attachment part 104.

The cartridge attachment part 104 includes recording liquid cartridges, each serving as a recording liquid container. The recording liquid cartridges indicate ink cartridges 110*k*, 110*c*, 110*m* and 110*y* containing recording liquid (ink) of different color materials such as black (K) ink, cyan (C) ink, magenta (M) ink and yellow (Y) ink (also simply referred to as an "ink cartridge 110" as a generic name when different colors are not considered). The ink cartridge 110 is attached to the cartridge attachment part 104 by inserting the ink cartridge 110 in the cartridge attachment part 104 from the front side to a rear side of the main body 101. The cartridge attachment part 104 further includes a front cover (cartridge cover) 106 configured to open when the ink cartridge 110 is inserted in the cartridge attachment part 104 and to close after the ink cartridge 110 has been inserted. Further, the ink cartridges 110*k*, 110*c*, 110*m* and 110*y* are aligned in a horizontal direction, each in an upright status.

The operation/display part 105 includes remaining ink display parts 111*k*, 111*c*, 111*m* and 111*y* configured to display respective remaining amounts of ink in the cartridges 110*k*, 110*c*, 110*m* and 110*y* at respective positions of the ink cartridges 110*k*, 110*c*, 110*m* and 110*y* when ink amounts in the cartridges 110*k*, 110*c*, 110*m* and 110*y* are in a near end status or in an end status. Further, the operation/display part 105 includes a power button 112, a sheet feed/printing restart button 113 and a cancel button 114.

Figure 2:
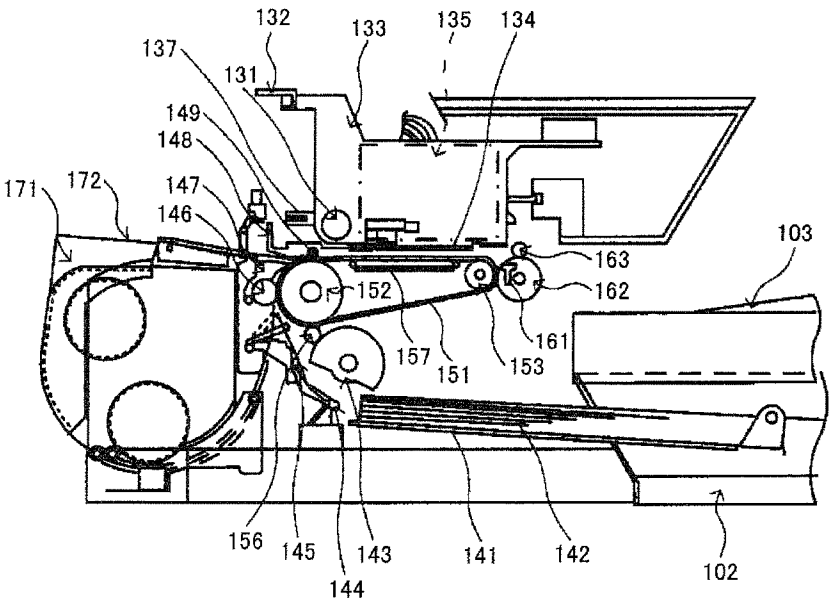
FIG. 2 is a side view illustrating a mechanical part of the ink-jet recording device.

Next, a mechanical part of the ink-jet recording device 100 according to the embodiment is described with reference to FIGS. 2 and 3. Note that FIG. 2 is a side view illustrating the mechanical part, and FIG. 3 is a plan view of a major part of the mechanical part.

Figure 3:
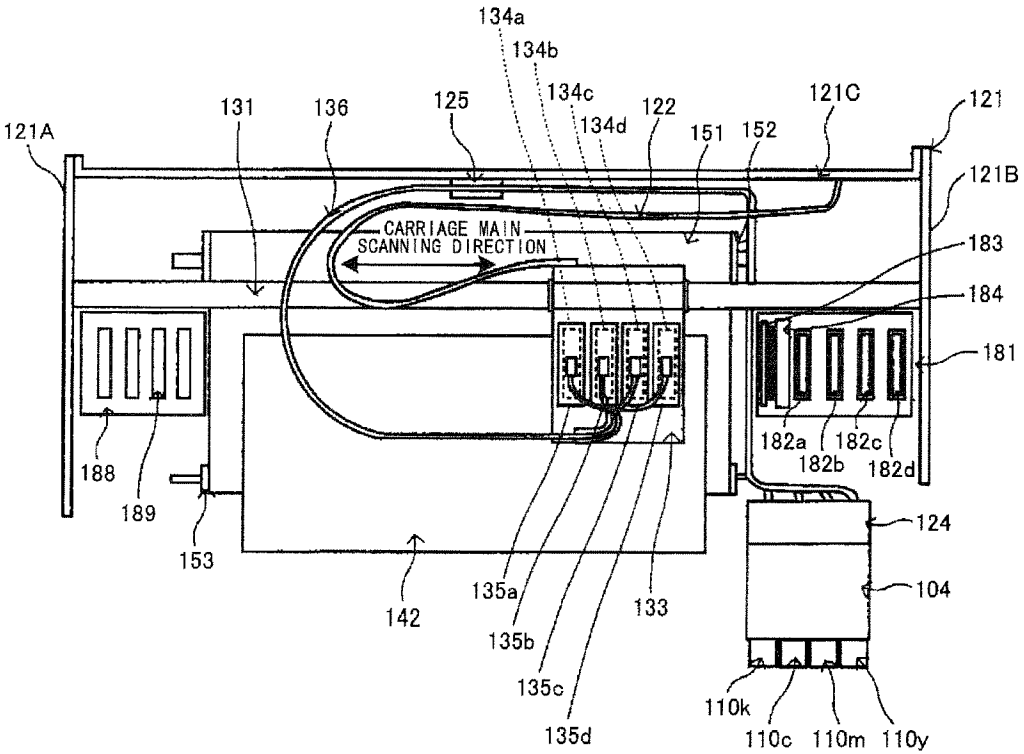
FIG. 3 is a plan view illustrating a major part of the mechanical part of the ink-jet recording device.

The mechanical part of the ink-jet recording device 100 includes a carriage 133 slidably supported by a guide rod 131 serving as a guide member and a stay 132 such that the carriage 133 is moved by a not-illustrated main-scanning motor via a timing belt in a carriage main-scanning direction indicated by a left-right arrow in FIG. 3. The guide rod 131 bridges left and right side plates 121A and 121B forming a frame 121.

The carriage 133 includes a liquid-jet head 134 composed of four ink-jet heads 134*a* to 134*d* to eject ink droplets of respective colors of yellow (Y), cyan (C), magenta (M), and black (B). The four ink-jet heads 134*a* to 134*d* constituting the liquid-jet head 134 are aligned in a direction perpendicular to the carriage main-scanning direction with ink ejecting directions of the four ink-jet heads 134*a* to 134*d* being downwardly directed. Note that the liquid-jet head 134 may have a configuration of having one or more ink-jet heads having nozzle arrays for ejecting ink drops of different colors.

Note that preferable examples of the liquid-jet head 134 formed of the four ink-jet heads 134*a* to 134*d* include a piezoelectric actuator such as a piezoelectric element, a thermal actuator utilizing phase change caused by liquid film boiling induced by an electrothermal element such as a heat element, a shape memory alloy actuator utilizing a metallic phase change due to temperature variation, and a static actuator utilizing electrostatic force, which are utilized as pressure generating units.

The carriage 133 includes head tanks 135*a* to 135*d* to supply ink of respective colors to the ink-jet recording heads 134*a* to 134*d*. The head tanks 135*a* to 135*d* are supplied with ink of respective colors via flexible ink supply tubes 136 from the ink cartridges 110*y*, 110*m*, 110*c* and 110*k* of respective colors attached to the cartridge attachment part 104. Note that the cartridge attachment part 104 is provided with a supply pump unit 124 to transfer ink of respective colors in the ink cartridges 110*y*, 110*m*, 110*c* and 110*k*. The ink supply tubes 136 are held by a locking member in the middle of routes of the ink supply tubes 136 on a back plate 121C forming the frame 121. The supply pump unit 124 may transfer ink in a reverse direction (reversed transfer).

Further, the mechanical part of the ink-jet recording device 100 further includes a semicircular feeding roll (paper feeding roll) 143 and a separation pad 144 made of a material having a high friction coefficient and facing the feeding roll 143. The feeding roll 143 and the separation pad 144 are utilized as a sheet-feeding part to feed sheets 142 stacked on a sheet stacking part (platen) 141 of a sheet-feeding tray 102, and the separation pad 144 is biased toward the feeding roll 143 side.

The mechanical part of the ink-jet recording device 100 further includes a guide member 145 for guiding the sheet 142, a counter roller 146, a transfer guide member 147 and a presser member 148 including an edge-pressing roll 149 in order to transfer the sheet 142 fed from the sheet-feeding part to a lower side of the liquid-jet head 134. The mechanical part of the ink-jet recording device 100 further includes a transfer belt 151 to electrostatically attract the sheet 142 in order to transfer the sheet 42 at a position facing the liquid-jet head 134.

The transfer belt 151 is an endless belt that is looped over a transfer roller 152 and a tension roller 153 so as to rotationally travel in a belt transferring direction (sub-scanning direction). Further, the mechanical part of the ink-jet recording device 100 further includes a charging roller 156 serving as a charging unit to electrically charge a surface of the transfer belt 151. The charging roller 156 is configured to be brought into contact with a surface layer of the transfer belt 151 and be rotationally driven by the rotation of the transfer belts 151. Further, a guide member 157 is arranged corresponding to a recording region in which recording is made by the liquid-jet head 134 at a rear side of the transfer belt 151.

The transfer belt 151 rotationally travels clockwise in the belt transferring direction illustrated in FIG. 2 driven by the transfer roller 152 that is rotationally driven by a not-illustrated sub-scanning motor via the timing belt.

The mechanical part of the ink-jet recording device 100 further includes a separation claw 161 to separate the sheet 142 from the transfer belt 151, a sheet-discharging roller 162 and a sheet-discharging roll 163 as a sheet-discharging part to discharge the sheet 142 on which an image is recorded by the liquid-jet head 134, and the catch tray 103 arranged at a lower side of the sheet-discharge roller 162.

The mechanical part of the ink-jet recording device 100 further includes a duplex printing unit 171 detachably attached at the back of the main body 101. The duplex printing unit 171 captures the sheet 142 rotationally transferred in a reverse direction of the transfer belt 151, reverses the sheet 42, and then feeds the reversed sheet 42 between the counter roller 146 and the transfer belt 151 again. The mechanical part of the ink-jet recording device 100 further includes a manual bypass tray 172 on top of the duplex printing unit 171.

Further, as illustrated in FIG. 3, the mechanical part of the ink-jet recording device 100 further includes a maintenance-restoration mechanism 181 arranged in a first non-printing region at one side of the carriage 133 in the carriage main-scanning direction. The maintenance-restoration mechanism 181 is provided for maintaining and restoring a condition of nozzles of the liquid-jet head 134.

The maintenance-restoration mechanism 181 includes cap members 182*a* to 182*d* (hereinafter called "caps 182*a* to 182*d*" or simply called a "cap 182" as a generic name for the cap members 182*a* to 182*d*) for capping the respective nozzle faces of the liquid-jet head 134, a wiper blade 183 serving as a wiper blade member for wiping the nozzle faces and a discharged non-printing ink receiver 184 for receiving non-printing ink discharged from the liquid-jet head 134 when thickened recording liquid is discharged as non-printing ink due to its failure to function as recording liquid. Note that the cap 182*a* serves as a suction/moisture-retention cap and the caps 182*b* to 182*d* serve as a moisture-retention caps.

The recording liquid (ink) discharged while the maintenance-restoration operation is performed by the maintenance-restoration mechanism 181, ink discharged into the cap 182, ink attached to the wiper blade 183 that is removed by a not-illustrated wiper cleaner and ink discharged into the discharged non-printing ink receiver 184 are all accumulated into a non-illustrated discharged liquid tank.

Further, as illustrated in FIG. 3, the mechanical part of the ink-jet recording device 100 further includes a discharged non-printing ink receiver 188 for receiving non-printing ink discharged from the liquid-jet head 134 when thickened recording liquid is discharged as non-printing ink due to its failure to function as recording liquid. The discharged non-printing ink receiver 188 is arranged in a second non-printing region at the other side of the carriage 33 in the carriage main-scanning direction. The discharged non-printing ink receiver 188 includes openings 189 along a nozzle array direction of the liquid-jet head 134.

In the ink-jet recording device 100 having the above configuration, the sheets 142 are separated from each other in the sheet-feeding tray 142, and the sheet 142 transferred in an approximately vertical direction is guided by a guide 145. The transferred sheet 142 is then further transferred by being sandwiched between the transfer belt 151 and the counter roller 146. A front end of the sheet 142 is guided by a transfer guide 137. The sheet 142 guided by the transfer guide 137 is then pressed by a front end pressurized roll 149 on the transfer belt 151. Thereafter, the transferring direction of the sheet 142 is changed by approximately 90 degrees.

In this process, voltages are alternately applied to the charging roller 156 from an AC bias supply unit of the later-described control part so as to repeatedly output plus and minus charges to the transfer belt 151. Accordingly, the transfer belt 151 is charged with the alternate charge voltage patterns. That is, the transfer belt 151 is charged with alternately arranged plus and minus charged bands having predetermined widths in a sub-scanning direction (i.e., traveling direction of the transfer belt 151). When the sheet 142 is fed onto the transfer belt 151 alternately charged with plus and minus charge voltage patterns, the sheet 142 is electrostatically attracted by the transfer belt 151. The sheet 142 attracted to the transfer belt 152 is then transferred in the sub-scanning direction by rotational traveling of the transfer belt 151.

The liquid-jet head 134 is driven according to image signals while moving the carriage 132 in the main-scanning direction based on main-scanning position information detected by a linear encoder 137. Accordingly, the liquid-jet head 134 ejects ink drops onto the stationary sheet 142 to record one line of an image, and the sheet 142 is then transferred by a predetermined amount. The liquid-jet head 134 subsequently ejects ink drops onto the sheet 142 to record the next line of the image. The recording operation is terminated when a signal indicating that a rear end of the sheet 142 has reached a recording region. The sheet 142 is thereafter discharged onto the catch tray 103.

Further, when the ink-jet recording device 100 is in a standby mode, the carriage 133 moves toward the maintenance-restoration mechanism 181 side, the liquid-jet head 134 is capped with the cap 182 to maintain moisture of the nozzles of the liquid-jet head 134. Accordingly, ink in the nozzles may be maintained in a moisturized condition to prevent the ink in the nozzles from being dried, thereby preventing ink discharge malfunction. While the liquid-jet head 134 is capped with the cap 182, the recording liquid is suctioned by a not-illustrated suction pump (may be called "nozzle suction" or "head suction") so as to conduct a restoration operation to discharge a thickened recording liquid and eliminate air bubbles. Further, a non-printing ink discharging operation is conducted to eject or discharge non-printing ink unassociated with recording or printing in the middle of recording or before the initiation of recording. Accordingly, the liquid-jet head 134 may be capable of maintaining stable ejecting performance.

Figure 4:
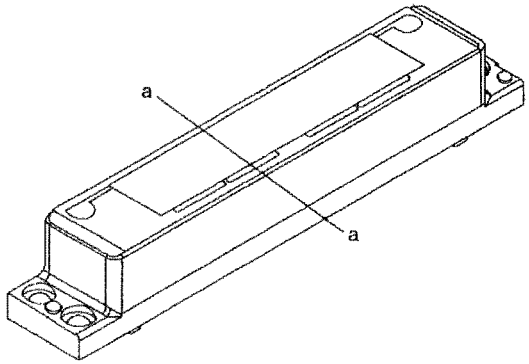
FIG. 4 is a perspective view illustrating an overall configuration of a liquid-jet head according to an embodiment.
Figure 5:
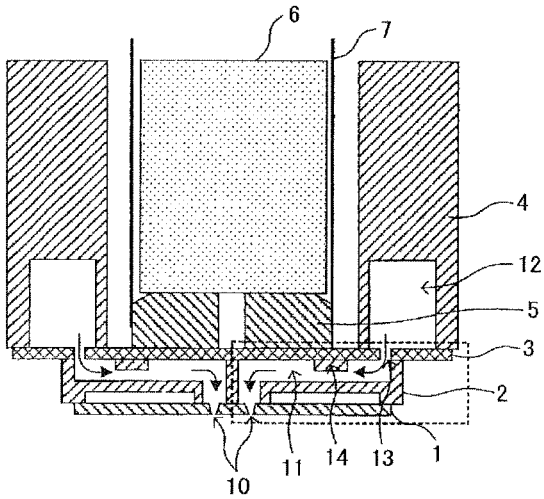
FIG. 5 is a cross-sectional diagram of the liquid-jet head illustrated in FIG. 4 cut along a line a-a.

FIG. 4 is a perspective view illustrating an overall configuration of the liquid-jet head 134 according to an embodiment. FIG. 5 is a cross-sectional diagram of the liquid-jet head 134 illustrated in FIG. 4 cut along a line a-a. As illustrated in FIG. 5, the liquid-jet head 134 according to the embodiment includes a piezoelectric element 5 as an energy application element. The piezoelectric element 5 is adhered to a base member 6 such that a drive signal having an optional drive waveform is applied to the piezoelectric element 5 via electric wiring 7 from not-illustrated electric circuit and control system. The piezoelectric element 5 may be displaced or deformed by the drive signal having the drive waveform to apply energy to a recording material inside the pressurized liquid chamber 11 via a diaphragm plate (diaphragm) 3. Hence, the recording material inside the pressurized liquid chamber 11 is ejected or discharged via the nozzle 10. The recording material inside the pressurized liquid chamber 11 is appropriately supplemented from the common liquid chamber 12 via the communicating path 13 in an amount corresponding to a reduced amount of the recording material. Further, the pressurized liquid chamber 11 is formed on a Si wafer by anisotropic etching. The pressurized liquid chamber 11 is etched to a predetermined depth, a part of which has a through hole to communicate with the nozzle 10. The liquid-jet head according to the embodiment is a face-shooter type in which a main deformation direction of the piezoelectric element 5 matches an ejecting direction of the liquid. The liquid-jet head of this type is becoming a mainstream type of the liquid-jet head. The liquid-jet head of this type has an advantage of easily bonding plate members of the liquid chamber configuration members.

In this embodiment, the piezoelectric element 5 is diced at 300 dpi intervals, and diced parts of the piezoelectric element 5 are aligned in two lines to face each other. The nozzles 10 and the corresponding pressurized liquid chambers 11 are aligned in a staggered arrangement at 150 dpi per line, and hence a user may be able to acquire resolution of 300 dpi by one scanning.

Figure 6:
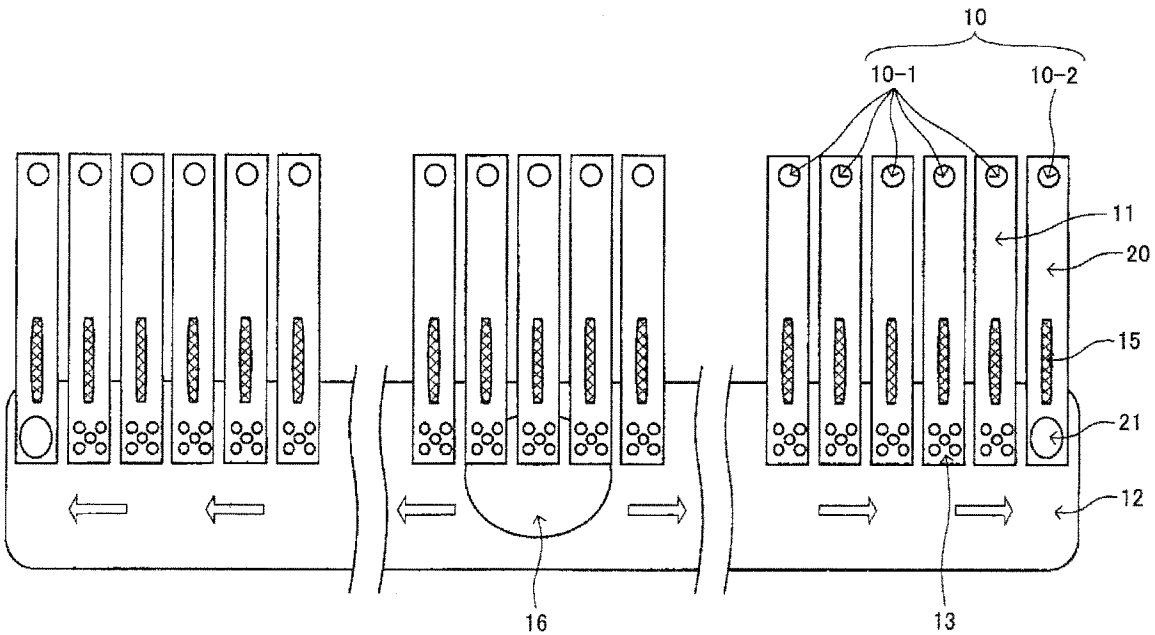
FIG. 6 is a view schematically illustrating an ink flow path of the liquid-jet head according to the embodiment.
Figure 7:
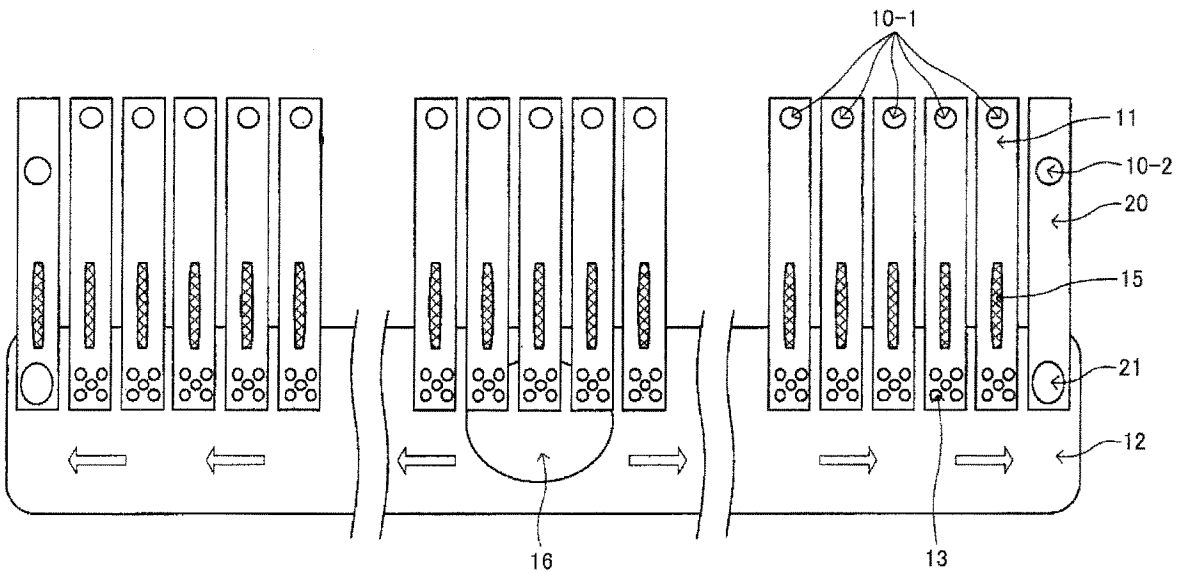
FIG. 7 is a view schematically illustrating an example of a discharge opening.
Figure 8:
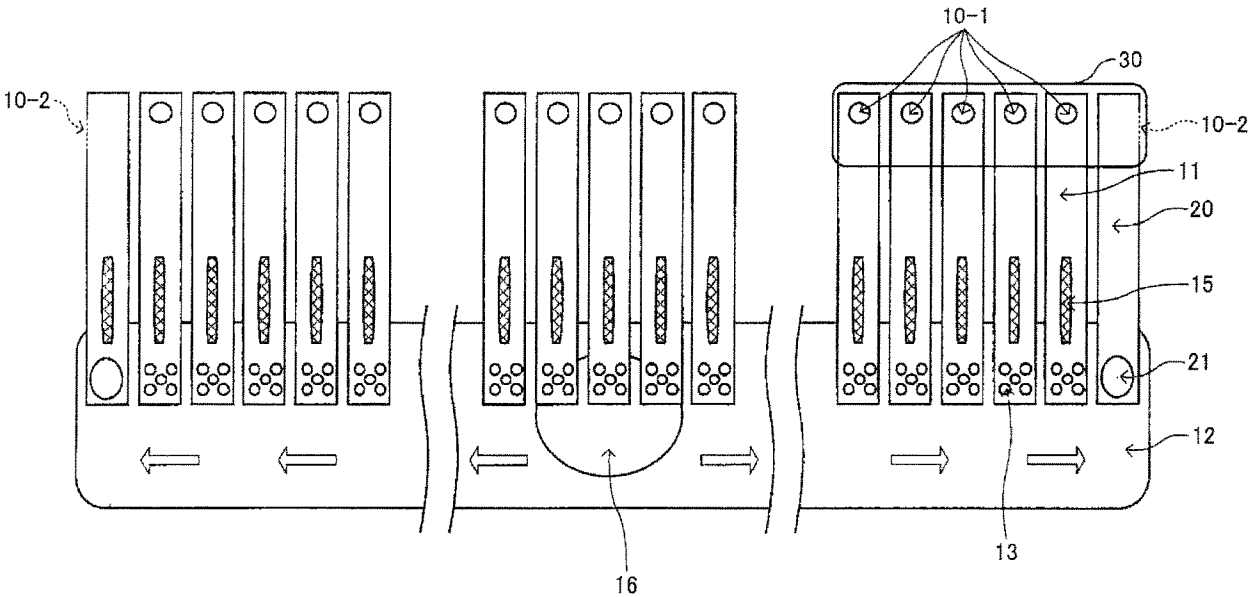
FIG. 8 is a view schematically illustrating another example of the discharge opening.

FIG. 6 is a view schematically illustrating an ink flow path of the liquid-jet head 134 according to the embodiment. FIG. 6 illustrates a part enclosed by a dotted line taken from FIG. 5. The pressurized liquid chamber 11 includes a fluid resistance part 15 having a partial island shape. The common liquid chamber 12 communicates with a conduit 16 to supply ink from an ink reservoir such as a not illustrated ink tank. In this example, the conduit 16 is arranged at an approximate center in a longitudinal direction of the common liquid chamber 12. Hence, if the ink flow occurs as a result of a normal printing or maintenance-restoration operations, ink is induced to flow in directions indicated by thick arrows in FIG. 6. If such ink flow has occurred, foreign particles and air bubbles existing within the common liquid chamber 12 travel along the ink flow to reach end regions on two sides of the common liquid chamber 12 located downstream in an ink supply direction. As illustrated in FIG. 6, opening areas corresponding to communicating paths 21 arranged at two sides of the common liquid chamber 12 are formed such that the opening area of each of the communicating paths 21 is larger than an opening area of each of the communicating paths 13. Note that the opening area of the communicating path 13 is smaller than an opening area of a nozzle 10-1. In this configuration, the communicating paths 13 may serve as filters to prevent the foreign particles from intruding into the corresponding pressurized liquid chambers 11. By contrast, an opening area of the communicating path 21 is larger than an opening area of a nozzle 10-2. In this configuration, after the nozzle 10-2 is capped with the cap member of the maintenance-restoration mechanism 181 during the maintenance-restoration operation, foreign particles and air bubbles pass through the openings of the communicating paths 21 to be externally discharged from the nozzles 10-2 via the caps to outside the liquid-jet head 134. Accordingly, it may be possible to suppress foreign particles or air bubbles from accumulating inside the common liquid chamber 12. Note that the aforementioned foreign particles are smaller than the opening area of the nozzle 10-2 such that the foreign particles may be able to pass through the nozzle (opening part) 10-2. The nozzle 10-2 may be utilized as so-called dummy bits that serve as bits not utilized for actually forming an image. In the embodiment illustrated in FIG. 6, the nozzle (opening part) 10-2 is utilized as the opening to discharge foreign particles or air bubbles received via the common liquid chamber 12 and the communicating path 21. However, such an opening to discharge foreign particles or air bubbles may be formed in a part of a nozzle surface of the nozzle 10-2 at a position differing from a position of the nozzle surface at which the opening of the nozzle 10-2 is formed as illustrated in FIG. 7. Alternatively, such an opening to discharge foreign particles or air bubbles may be formed, as illustrated in FIG. 8, in a part of a side wall of a pressurized liquid chamber (air bubble discharge chamber) 20.

Figure 9:
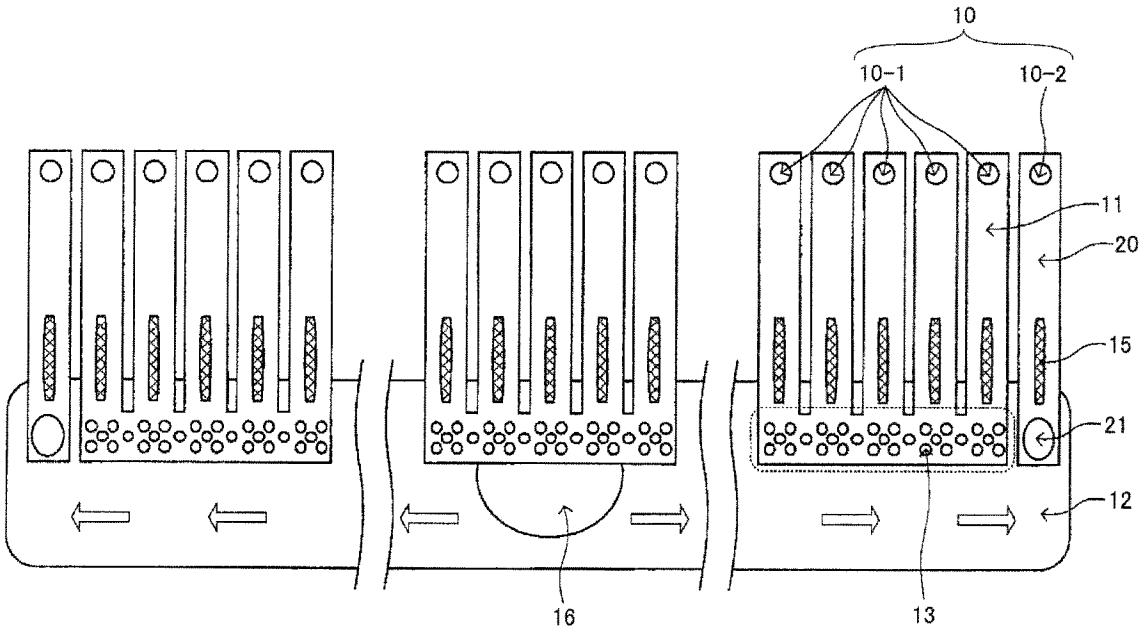
FIG. 9 is a view schematically illustrating an ink flow path of a first modification of the liquid-jet head according to the embodiment.

FIG. 9 is a view schematically illustrating an ink flow path of a first modification of the liquid-jet head 134 according to the embodiment. In FIG. 9, reference numerals that are identical to those in FIG. 6 indicate components identical to those in FIG. 6. In this example, the adjacent pressurized liquid chambers 11 corresponding to five nozzles 10-2 are connected at positions near the communicating path 21. In this configuration, the number of openings of the communicating paths 13 connecting to the pressurized liquid chamber 11 may be increased. The example of FIG. 6 has only five openings as the communicating paths 13 corresponding to one pressurized liquid chamber 11. Hence, if some of the five communicating paths are simultaneously clogged with foreign particles or air bubbles, fluid resistance of the communicating paths 13 may be increased, which may adversely affect ink discharge properties. Further, if all five communicating paths 13 are clogged in the worst scenario, it may be difficult to supply ink via the communicating paths 13. However, the aforementioned ink discharge malfunction may be dramatically reduced by connecting the adjacent (five) pressurized liquid chambers 11 to communicate with one another as illustrated in FIG. 9. In this case, the pressurized liquid chambers 20 arranged in both end regions one on each end of the pressurized liquid chamber 12 and the pressurized liquid chambers 11 adjacent to the respective pressurized liquid chambers 20 are not in communication with one another. Note that the pressurized liquid chambers 20 arranged at the two end regions of the pressurized liquid chamber 12 are utilized as dummy bits so that an opening area of the communicating path 21 is formed larger than an opening area of the communicating path 13.

Figures 10A, 10B:
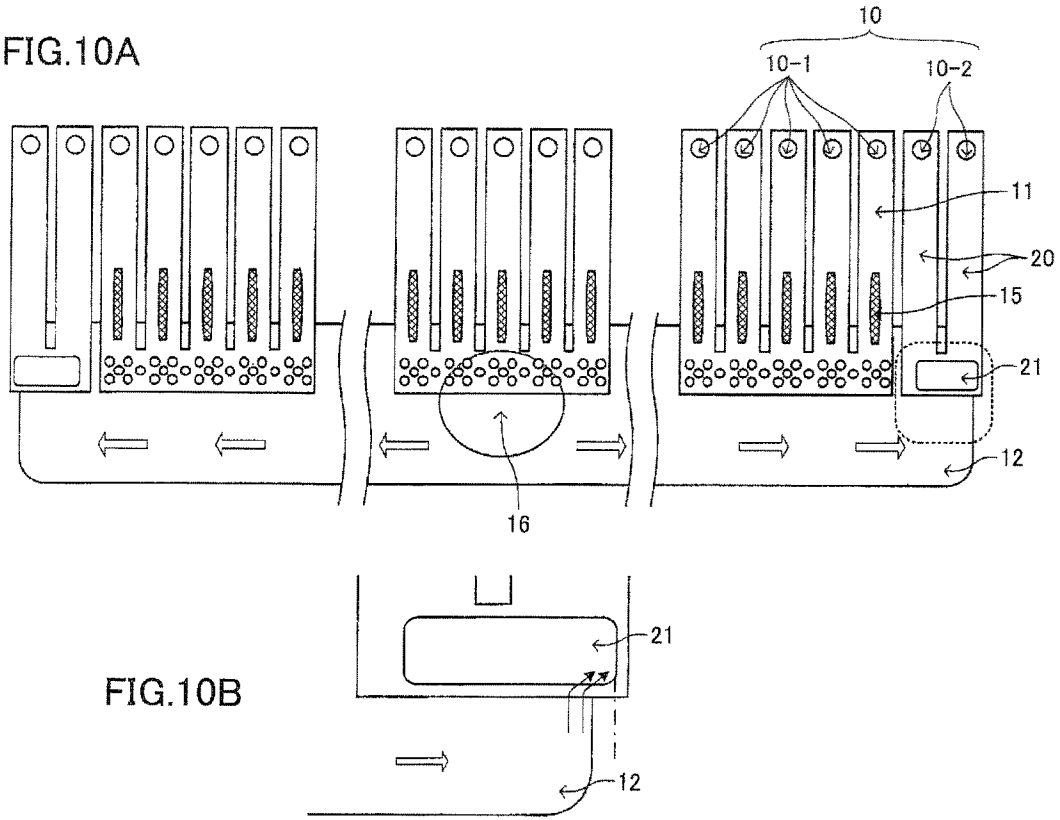
FIGS. 10A and 10B are views schematically illustrating an ink flow path of a second modification of the liquid-jet head according to the embodiment.

FIGS. 10A and 10B are views schematically illustrating an ink flow path of a second modification of the liquid-jet head 134 according to the embodiment. In FIGS. 10A and 10B, reference numerals that are identical to those in FIG. 6 indicate components identical to those in FIG. 6. In this example, dummy bits serving as the pressurized liquid chambers 20 in the two end regions on the two sides of the common liquid chamber 12 are determined as two bits, and the fluid resistance part having an island shape is eliminated from the dummy bits. In this configuration, ink may flow easily due to a decrease in fluid resistance of the dummy bits, and relatively large foreign particles and air bubbles may be easily discharged from the liquid-jet head 134. It may be possible to increase the dummy bits; however, the size of the liquid-jet head 134 may be increased with the increase of the dummy bits. Hence, the appropriate number of dummy bits may preferably be increased based on applications. Further, in this example, an outermost side (outermost end) in a longitudinal direction of the opening of the communicating path 21 is located outside the common liquid chamber 12. This configuration may facilitate causing foreign particles or air bubbles to flow toward the end regions on two sides of the common liquid chamber 12 and finally flow into the communicating path 21. In the related art, fluid resistance of the end part bits may be reduced by removing the fluid resistance part residing within the dummy bit liquid chamber or by increasing a cross sectional area of the liquid chamber in order to facilitate air bubbles in the end regions on the two sides of the common liquid chamber. However, it may not seem to be sufficient. That is, if small openings such as the communicating path 13 illustrated in FIG. 8 are formed in place of the communicating path 21 in the end part dummy bits, air bubbles existing inside the common liquid chamber 12 may be easily trapped by these small openings. Since smaller air bubbles have particularly high surface tension, a meniscus strained across the small communicating path may not easily be broken by simple pressure application and hence the air bubbles may remain in the common liquid chamber 12. Accordingly, the size of the opening of the communicating path 21 may need to be increased.

Figure 11:
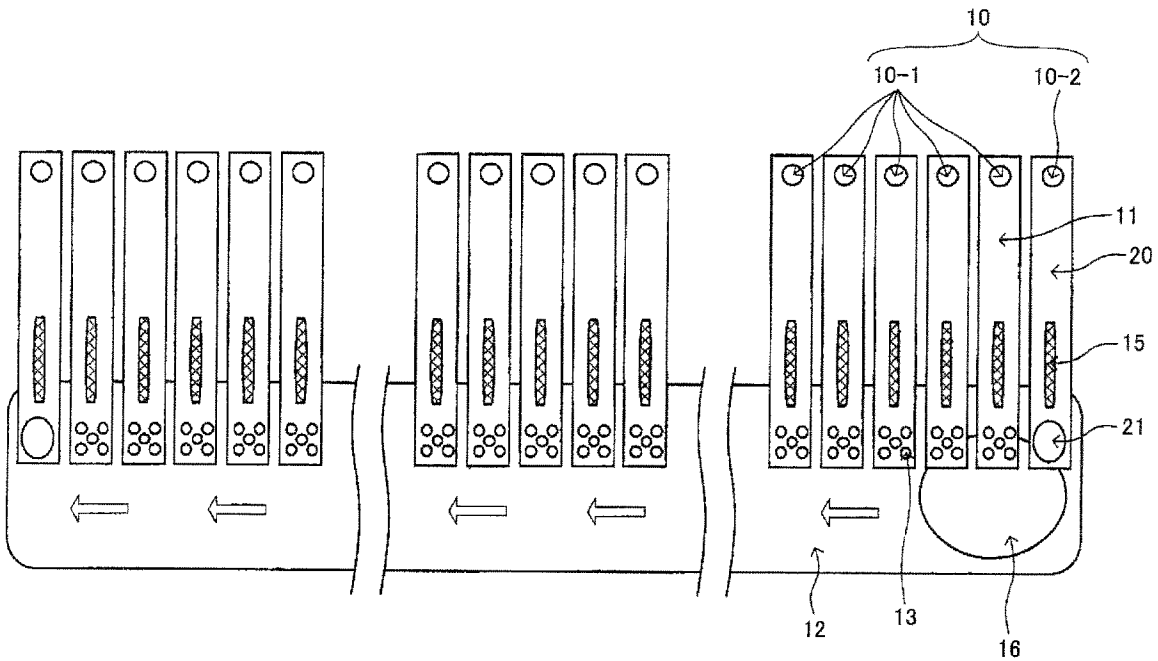
FIG. 11 is a view schematically illustrating an ink flow path of a third modification of the liquid-jet head according to the embodiment.

FIG. 11 is a view schematically illustrating ink flow paths of a third modification of the liquid-jet head 134 according to the embodiment. In FIG. 11, reference numerals that are identical to those in FIG. 6 indicate components identical to those in FIG. 6. In this example, a conduit 16 communicating with the common liquid chamber 12 is formed in an end region on one end of the common liquid chamber 12. It may be necessary to arrange the conduit 16 as described above with the limitation of the layout. In this case, an opening area of the communicating path 21 according to the third modification is configured to be larger than the opening area of the communicating path 21 according to the aforementioned embodiment, the first and the second modifications at a position of an end region opposite to the end region having the conduit 16. Further, the pressurized liquid chambers 11 may be connected at a position of the communicating paths 13, or a bit in an end part located downstream of an ink flow direction in the common liquid chamber 12 may be utilized as a dummy bit.

The descriptions of the embodiment and modifications are only examples and the embodiment or modifications of the embodiment may exhibit effects specific to the following aspects.

Aspect A:

A liquid-jet head includes a communicating path configured to communicate with a part of a common liquid chamber including an air bubble remaining part located in a region downstream in a liquid flow direction inside the common liquid chamber, the air bubble remaining part being a place where air bubbles are likely to remain; and an air bubble discharge chamber having an opening to discharge air bubbles having entered via the communicating path, in which an air bubble remaining part having the entered air bubbles are discharged via the opening of the air bubble discharge chamber during maintenance-restoration operations.

With this configuration, as illustrated in the embodiment, air bubbles may be prevented from intruding into the pressurized liquid chambers 11 by filters having openings of the communicating paths 13 communicating with the corresponding pressurized liquid chambers 11 and the common liquid chamber 12; however, the air bubbles may continue to remain inside the common liquid chamber 12 to clog the filters. Further, the liquid-jet head further includes an ink flow path in which the liquid inside the common liquid chamber 12 flows via the communicating path 21 of the dummy pressurized liquid chamber 20 to the discharging nozzle (opening part) 10-2 of the dummy pressurized liquid chamber (air bubble discharge chamber) 20. Since the dummy pressurized liquid chamber 20 acquires a negative pressure due to a negative pressure inside the common liquid chamber 12 during a time other than the maintenance-restoration operation time, the discharging nozzle 10-2 of the dummy pressurized liquid chamber 20 does not discharge a liquid. For example, when the common liquid chamber 12 has a positive pressure (atmospheric pressure) during the maintenance-restoration operation, the liquid inside the common liquid chamber 12 flows via the communicating path 21 of the dummy pressurized liquid chamber 20 to the discharging nozzle (opening part) 10-2 of the dummy pressurized liquid chamber (air bubble discharge chamber) 20. With this configuration, even if air bubbles remain in (air bubble remaining part near) the openings 13 of the filter on the common liquid chamber 12 side, the air bubbles may be discharged outside via the dummy pressurized liquid chamber (air bubble discharge chamber) 20 during the maintenance-restoration operation. The filters are provided in each of the corresponding pressurized liquid chambers 11 to prevent air bubbles from intruding into the pressurized liquid chambers 11. Further, with this configuration, the filters between the corresponding pressurized liquid chambers 11 and the common liquid chamber 12 may not be clogged by the air bubbles or foreign particles so that a sufficient amount of ink may be supplied to the pressurized liquid chambers 11. Hence, ink discharge malfunction due to the clogging of the filters between the pressurized liquid chambers 11 and the common liquid chamber 12 may be suppressed.

Aspect B:

In the configuration of the liquid-jet head according to the above aspect A, the opening of the air bubble discharge chamber is formed in a part of a wall surface of walls constituting the air bubble discharge chamber. With this configuration, as illustrated in the embodiment, the nozzle 10-2 of the dummy pressurized liquid chamber 20 may be capped with the cap member or the like during the maintenance-restoration operations to discharge air bubbles that continue remaining inside the common liquid chamber 12 outside the common liquid chamber 12. Thus, the ink discharge malfunction may be suppressed.

Aspect C:

In the configuration of the liquid-jet head according to the above aspect B, the opening of the air bubble discharge chamber is formed in a part of a wall surface facing in the same direction as a nozzle surface facing direction. With this configuration, as illustrated in the embodiment, the nozzle 10-2 of the dummy pressurized liquid chamber 20 may be capped with the cap member or the like during the maintenance-restoration operation to discharge air bubbles that continue to remain inside the common liquid chamber 12 from the liquid-jet head 134. Thus, the ink discharge malfunction may be suppressed.

Aspect D:

In the configuration of the liquid-jet head according to any one of the above aspects A to C, an opening area of the communicating path in the air bubble discharge chamber is larger than an opening area of the communicating path of the pressurized liquid chamber 11. With this configuration, as illustrated in the embodiment, the air bubbles that continue to remain inside the common liquid chamber 12 may be captured inside the dummy pressurized liquid chamber 20. Thus, the ink discharge malfunction may be suppressed.

Aspect E:

In the configuration of the liquid-jet head according to the above aspect a, two or more air bubble discharge chambers are formed in a region downstream in a liquid flow direction including an air bubble remaining part inside the common liquid chamber 12. With this configuration, as illustrated in the embodiment, the air bubbles that continue to remain inside the common liquid chamber 12 may be efficiently captured inside the dummy pressurized liquid chamber 20. Thus, the ink discharge malfunction may be suppressed.

Aspect F:

In the configuration of the liquid-jet head according to the above aspect E, any two or more of the communicating paths of the air bubble discharge chambers may be connected. With this configuration, as illustrated in the second modification of the embodiment, the opening area of the communicating path 21 of the dummy pressurized liquid chamber 20 may be increased and hence, the air bubbles that continue to remain inside the common liquid chamber 12 may be efficiently captured inside the dummy pressurized liquid chamber 20. Thus, the ink discharge malfunction may be suppressed.

Aspect G:

In the configuration of the liquid-jet head according to any one of the above aspects A to F, a virtual line extending from a liquid chamber wall downstream of the liquid flow direction inside the common liquid chamber toward the air bubble discharge chamber matches an end part of an outermost inner wall of the communicating path of the air bubble discharge chamber. Or, the virtual line may extend from the liquid chamber wall to an inner part of the communicating path of the air bubble discharge chamber. As illustrated in the embodiment, air bubbles are likely to remain downstream of the common liquid chamber. Hence, with this configuration, the common liquid chamber includes no such air bubble remaining part so as to allow the air bubbles to enter into the communicating path of the air bubble discharge chamber. Thus, the ink discharge malfunction may be suppressed.

Aspect H:

In the configuration of the liquid-jet head according to any one of the above aspects A to G, two or adjacently arranged pressurized liquid chambers 11 having openings are connected. With this configuration, as illustrated in the first modification of the embodiment, the number of communicating paths 13 corresponding to each of the pressurized liquid chambers 11 may be increased. Accordingly, even if some of the communicating paths are clogged, the liquid may still be supplied to the connected pressurized liquid chambers 11. Thus, the ink discharge malfunction may be suppressed.

Aspect I:

A liquid-jet head includes a communicating path configured to communicate with a part of a common liquid chamber including a foreign particle remaining part located in a region downstream in a liquid flow direction inside the common liquid chamber, the foreign particle remaining part being a place where foreign particles are likely to remain; and a foreign particle discharge chamber having an opening to discharge foreign particles having entered via the communicating path, in which the entered foreign particles are discharged via the opening of the foreign particle discharge chamber during maintenance-restoration operations. With this configuration, as illustrated in the embodiment, foreign particles may be prevented from intruding into the pressurized liquid chambers 11 by a filter having openings of the communicating paths 13 communicating with the corresponding pressurized liquid chambers 11 and the common liquid chamber 12; however, the foreign particles may continue to remain inside the common liquid chamber 12 to clog the filter. Hence, the liquid-jet head 134 further includes a foreign particle discharge chamber including a communicating path 13 to communicate with the common liquid chamber 12 and an opening to externally discharge foreign particles. The foreign particle discharge chamber is arranged in a region downstream of the common liquid chamber 12 where foreign particles are likely to remain. The foreign particle discharge chamber serves as a flow path via which remaining foreign particles are externally discharged. Hence, foreign particles are discharged via the foreign particle discharge chamber during the maintenance-restoration operation. With this configuration, the filters will not be clogged so that a sufficient amount of ink may be supplied to the pressurized liquid chambers 11. Thus, the ink discharge malfunction may be suppressed.

Aspect J:

A liquid-jet device includes the liquid-jet head according to any one of the aspects A to I. With this configuration, as illustrated in the embodiment, the liquid-jet device may be capable of stably ejects the liquid. Accordingly, a highly reliable liquid-jet device may be provided.

According to an embodiment, there is provided a liquid-jet head including a flow path in which a liquid inside a common liquid chamber flows into a discharge opening of an air bubble discharge chamber via a communicating path between the common liquid chamber and an air bubble discharge chamber, and the air bubble discharge chamber. Since a content of the air bubble discharge chamber is in a negative pressure state according to a negative pressure state of a content of the common liquid chamber during a time other than the maintenance-restoration operation time, the liquid will not be discharged from the discharge opening of the air bubble discharge chamber. For example, when the content of the common liquid chamber is in a positive pressure (atmospheric pressure) state during the maintenance-restoration operation, the liquid inside the common liquid chamber flows via the communicating path of the air bubble discharge chamber to the discharge opening of the air bubble discharge chamber. With this configuration, even if air bubbles remain in the filter on the common liquid chamber side, the air bubbles may be discharged outside via the air bubble discharge chamber during the maintenance-restoration operation. The filter is provided in each of the pressurized liquid chambers to prevent air bubbles from intruding into the pressurized liquid chambers. Accordingly, the air bubbles will not continue to remain inside the common liquid chamber and hence, the filters will not be clogged with the air bubbles. Thus, a sufficient amount of the liquid may be supplied to each of the pressurized liquid chambers, which may suppress liquid discharge malfunction due to the clogging of the filters between the corresponding pressurized liquid chambers and the common liquid chamber.

According to another embodiment, there is provided a liquid-jet head including a flow path in which a liquid inside a common liquid chamber flows into a discharge opening of a foreign particle discharge chamber via a communicating path between the common liquid chamber and a foreign particle discharge chamber, and the foreign particle discharge chamber. Since a content of the foreign particle discharge chamber is in a negative pressure state according to a negative pressure state of a content of the common liquid chamber during a time other than the maintenance-restoration operation time, the liquid will not be discharged from the discharge opening of the foreign particle discharge chamber. For example, when the content of the common liquid chamber is in a positive pressure (atmospheric pressure) state during the maintenance-restoration operation, the liquid inside the common liquid chamber flows via the communicating path of the foreign particle discharge chamber to the discharge opening of the foreign particle discharge chamber. With this configuration, even if foreign particles remain in the filters on the common liquid chamber side, the foreign particles may be discharged outside via the foreign particle discharge chamber during the maintenance-restoration operation. The filters are provided in the corresponding pressurized liquid chambers to prevent foreign particles from intruding into the pressurized liquid chambers. Accordingly, the foreign particles will not continue to remain inside the common liquid chamber and hence, the filters will not be clogged with the foreign particles. Thus, a sufficient amount of the liquid may be supplied to each of the pressurized liquid chambers, which may suppress liquid discharge malfunction due to the clogging of the filters between the corresponding pressurized liquid chambers and the common liquid chamber.

The embodiments and modifications may be able to provide a distinctive effect for suppressing liquid discharge malfunction due to the clogging of filters between the corresponding pressurized liquid chambers and the common liquid chamber.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2011-202341 filed on Sep. 15, 2011, the entire contents of which are hereby incorporated herein by reference.

What is claimed is:

1. A liquid-jet head comprising:

a plurality of nozzles;

a plurality of pressurized liquid chambers configured to communicate with the respective nozzles;

a common liquid chamber configured to communicate with each of the pressurized liquid chambers, each of the common liquid chamber and the pressurized liquid chambers having a negative pressure of a predetermined value;

a plurality of first communicating paths configured to communicate between the common liquid chamber and the corresponding pressurized liquid chambers, each of the first communicating paths serving as a filter to prevent air bubbles residing in the common liquid chamber from intruding into the corresponding pressurized liquid chamber, the filter having a plurality of openings, each of the openings having an opening area smaller than an opening area of each of the nozzles, the openings serving as a liquid flow path between the common liquid chamber and the corresponding pressurized liquid chamber;

an air bubble discharge chamber including an opening part from which air bubbles are discharged in a maintenance-restoration operation; and a second communicating path configured to communicate between the air bubble discharge chamber and an air bubble remaining part inside the common liquid chamber where air bubbles are likely to remain, wherein the air bubbles enter the opening part of the air bubble discharge chamber via the second communicating path, wherein the second communicating path is configured to bridge between an internal part of the common liquid chamber and a wall surface of a member constituting the common liquid chamber, in a nozzle array direction, and wherein the opening part of the air bubble discharge chamber is formed in apart of a wall surface of a member constituting the air bubble discharge chamber, and the opening part of the air bubble discharge chamber is formed in the part of the wall surface that faces in a direction that is same as a direction in which a nozzle surface in which the nozzles are disposed faces.

2. The liquid-jet head as claimed in claim 1, wherein an opening area of the opening part of the air bubble discharge chamber is larger than an opening area of the first communicating path in the pressurized liquid chamber.

3. The liquid-jet head as claimed in claim 1, wherein two or more of the air bubble discharge chambers are formed in a region downstream in a liquid flow direction including the air bubble remaining part inside the common liquid chamber.

4. The liquid-jet head as claimed in claim 3, wherein two or more of the second communicating paths communicating with the air bubble discharge chambers are connected with each other.

5. The liquid-jet head as claimed in claim 1, wherein a virtual line extending from a liquid chamber wall located downstream of a liquid flow direction inside the common liquid chamber toward the air bubble discharge chamber matches an end part of an outermost inner wall of the second communicating path communicating with the air bubble discharge chamber, or the virtual line extends from the liquid chamber wall to an inner part of the second communicating path communicating with the air bubble discharge chamber.

6. The liquid-jet head as claimed in claim 1, wherein the pressurized liquid chambers that are adjacently arranged are connected to each other.

7. A liquid-jet device comprising the liquid-jet head as claimed in claim 1.

8. The liquid-jet head as claimed in claim 1, wherein at least one of the pressurized liquid chambers includes a fluid resistance part having a partial island shape.

9. A liquid-jet head comprising:

a plurality of nozzles;

a plurality of pressurized liquid chambers configured to communicate with the respective nozzles;

a common liquid chamber configured to communicate with each of the pressurized liquid chambers, each of the common liquid chamber and the pressurized liquid chambers having a negative pressure of a predetermined value;

a plurality of first communicating paths configured to communicate between the common liquid chamber and the corresponding pressurized liquid chambers, each of the first communicating paths serving as a filter to prevent foreign particles residing in the common liquid chamber from intruding into the corresponding pressurized liquid chamber, the filter having a plurality of openings, each of the openings having an opening area smaller than an opening area of each of the nozzles, the openings serving as a liquid flow path between the common liquid chamber and the corresponding pressurized liquid chamber;

a foreign particle discharge chamber including an opening part from which the foreign particles are discharged in a maintenance-restoration operation; and a second communicating path configured to communicate between the foreign particle discharge chamber and a foreign particle remaining part inside the common liquid chamber where foreign particles are likely to remain, wherein the foreign particles enter the opening part of the foreign particle discharge chamber via the second communicating path, wherein the second communicating path is configured to bridge between an internal part of the common liquid chamber and a wall surface of a member constituting the common liquid chamber, in a nozzle array direction, and wherein the opening part of the foreign particle discharge chamber is formed in a part of a wall surface of a member constituting the foreign particle discharge chamber, and the opening part of the foreign particle discharge chamber is formed in the part of the wall surface that faces in a direction that is same as a direction in which a nozzle surface in which the nozzles are disposed faces.

* * * * *